US009176415B2

(12) United States Patent
Kobayashi

(10) Patent No.: US 9,176,415 B2
(45) Date of Patent: Nov. 3, 2015

(54) CHARGING UNIT, IMAGE FORMING APPARATUS, AND CHARGING UNIT SUPPORT MEMBER

(71) Applicant: FUJI XEROX CO., LTD, Minato-ku, Tokyo (JP)

(72) Inventor: Takuya Kobayashi, Kanagawa (JP)

(73) Assignee: FUJI XEROX CO., LTD, Tokyo (JP)

( * ) Notice: Subject to any disclaimer, the term of this patent is extended or adjusted under 35 U.S.C. 154(b) by 0 days.

(21) Appl. No.: 14/257,390

(22) Filed: Apr. 21, 2014

(65) Prior Publication Data

US 2015/0098725 A1 Apr. 9, 2015

(30) Foreign Application Priority Data

Oct. 8, 2013 (JP) ..... 2013-211239

(51) Int. Cl.
*G03G 21/00* (2006.01)
*G03G 15/02* (2006.01)

(52) U.S. Cl.
CPC ..... *G03G 15/0225* (2013.01)

(58) Field of Classification Search
CPC ..... G03G 21/1842; G03G 21/1661; G03G 21/1676; G03G 21/1814; G03G 15/04
USPC ..... 399/100, 115
See application file for complete search history.

(56) References Cited

U.S. PATENT DOCUMENTS

| | | | | |
|---|---|---|---|---|
| 7,668,477 | B2 * | 2/2010 | Honobe et al. | 399/100 |
| 2010/0104320 | A1 * | 4/2010 | Moon et al. | 399/115 |
| 2011/0069988 | A1 * | 3/2011 | Kurita et al. | 399/100 |

FOREIGN PATENT DOCUMENTS

| | | | |
|---|---|---|---|
| JP | 2007-33246 | A | 2/2007 |
| JP | 2009-80304 | A | 4/2009 |
| JP | 2009-116373 | A | 5/2009 |

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

Provided is a charging unit including a charging member that is provided and comes in contact with a surface of an image holding member holding an image to charge the image holding member, a cleaning member that is provided and comes in contact with a surface of the charging member to clean the charging portion which is provided with an opening portion that opens in a direction intersecting rotating shafts of the charging member and the cleaning member, and which supports one end of the charging member is inserted through the opening portion to support the one end of the charging member, and a second support portion which is formed by being connected to the first support portion and which supports one end of the cleaning member which is inserted from the opening portion through the first support portion.

8 Claims, 8 Drawing Sheets

CHARGING UNIT, IMAGE FORMING APPARATUS, AND CHARGING UNIT SUPPORT MEMBER

CROSS-REFERENCE TO RELATED APPLICATIONS

This application is based on and claims priority under 35 USC 119 from Japanese Patent Application No. 2013-211239 filed Oct. 8, 2013.

BACKGROUND

Technical Field

The present invention relates to a charging unit, an image forming apparatus, and a charging unit support member.

SUMMARY

According to an aspect of the invention, there is provided a charging unit including:

a charging member that is rotatably provided and comes in contact with a surface of an image holding member holding an image to charge the image holding member;

a cleaning member that is rotatably provided and comes in contact with a surface of the charging member to clean the charging member; and a support member that includes:

a first support portion which is provided with an opening portion that opens in a direction intersecting rotating shafts of the charging member and the cleaning member, and which supports one end of the charging member is inserted through the opening portion to support the one end of the charging member; and a second support portion which is formed by being connected to the first support portion and which supports one end of the cleaning member which is inserted from the opening portion through the first support portion.

BRIEF DESCRIPTION OF THE DRAWINGS

Exemplary embodiments of the present invention will be described in detail based on the following figures, wherein.

DETAILED DESCRIPTION

First Exemplary Embodiment

Hereinafter, an exemplary embodiment of the invention is described in detail with reference to attached drawings.

Figure 1:
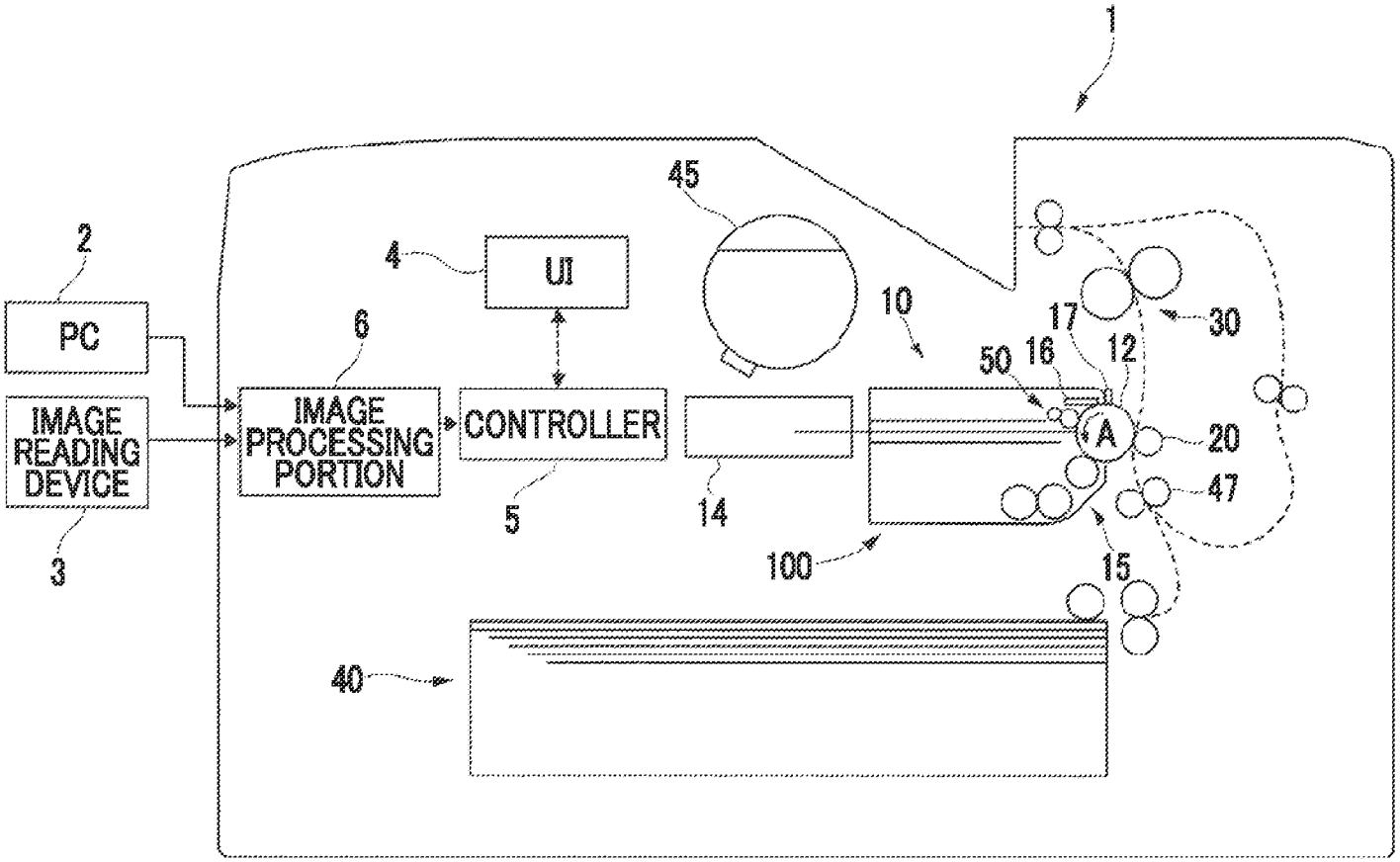
FIG. 1 is a view illustrating an example of a configuration of an image forming apparatus to which an exemplary embodiment is applied.

FIG. 1 is a view illustrating an example of a configuration of an image forming apparatus 1 to which the exemplary embodiment is applied. The image forming apparatus 1 illustrated in FIG. 1 is a single color printer and includes an image forming portion 10 that forms an image corresponding to image data, a user interface (UI) 4 that receives instructions from a user and displays messages and the like to the user, a controller 5 that controls an operation of an entirety of the image forming apparatus 1, and an image processing portion 6 that, for example, is connected to an external device such as a personal computer (PC) 2 or an image reading device 3 and that performs image processing on image data received therefrom.

Further, the image forming apparatus 1 includes a recording material supply portion 40 that supplies a recording material to the image forming portion 10 and a toner cartridge 45 that supplies toner to the image forming portion 10.

Figure 2:
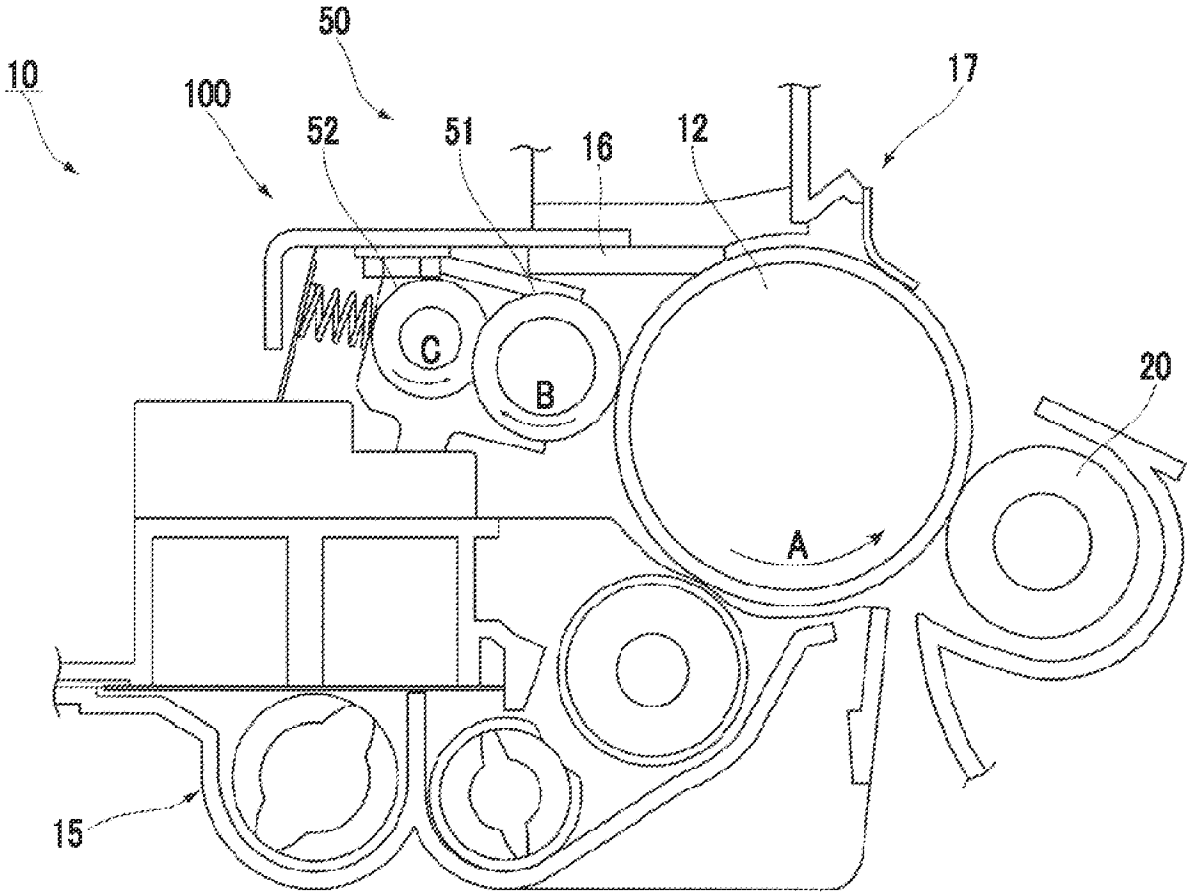
FIG. 2 is a view illustrating an example of a configuration of an image forming portion to which an exemplary embodiment is applied.

FIG. 2 is a view illustrating an example of a configuration of the image forming portion 10 to which the exemplary embodiment is applied.

As illustrated in FIGS. 1 and 2, the image forming portion 10 includes a photoconductor drum 12 as an example of an image holding member, which is rotatably provided and forms an electrostatic latent image and then holds a toner image, a charging unit 50 as an example of a charging unit, which charges a surface of the photoconductor drum 12, an exposure device 14 that exposes the photoconductor drum 12 charged by the charging unit 50 based on the image data, a developing unit 15 that develops the electrostatic latent image formed on the photoconductor drum 12, and a cleaner 16 that cleans the surface of the photoconductor drum 12 after transfer is performed. Moreover, the photoconductor drum 12 according to the exemplary embodiment includes a rotating shaft (not illustrated) and is disposed so that an axial direction thereof is directed from the front side (the front side in the view) toward the rear side (a depth side in the view) of the image forming apparatus 1.

Further, the image forming portion 10 includes a transfer roller 20 that forms a transfer portion between the photoconductor drum 12 and the transfer roller 20, and transfers the toner image formed on the photoconductor drum 12 onto the recording material, and a fixing unit 30 that fixes the toner image that is transferred onto the recording material.

Further, the image forming portion 10 includes a separation unit 17 that separates the recording material on which the toner image is transferred by the transfer roller 20 from the surface of the photoconductor drum 12.

In the image forming portion 10 according to the exemplary embodiment, the photoconductor drum 12, the charging unit 50, the developing unit 15, the cleaner 16 and the separation unit 17 are configured as an image forming module 100 that is integrally formed. Then, the image forming module 100 is attachably and detachably configured with respect to the image forming apparatus 1, and is replaced depending on a life or the like of the photoconductor drum 12.

In the image forming apparatus 1, the image forming portion 10 performs an image forming operation based on various control signals supplied from the controller 5. That is, for the image data input from the PC 2 or the image reading device 3, image processing is performed by the image processing portion 6 under control by the controller 5 and the image data is supplied to the image forming portion 10. Then, in the image forming portion 10, the photoconductor drum 12 is charged to a predetermined potential by the charging unit 50 while rotating in arrow direction A and is exposed by the exposure device 14 radiating light based on the image data transmitted from the image processing portion 6. Therefore, an electrostatic latent image corresponding to the image data is formed on the photoconductor drum 12. Then, the electrostatic latent image formed on the photoconductor drum 12 is developed by the developing unit 15, for example, as the toner image of black (K) and the toner image corresponding to the image data is formed on the photoconductor drum 12.

The toner image formed on the photoconductor drum 12 is electrostatically transferred to the recording material transported to the transfer portion by the transfer roller 20.

Thereafter the recording material on which the toner image is transferred is separated from the surface of the photoconductor drum 12 by the separation unit 17 and is transported to the fixing unit 30. The toner image on the recording material transported to the fixing unit 30 is fixed on the recording material by receiving fix processing using heat and a pressure by the fixing unit 30. Then, the recording material on which a fixed image is formed is transported to a discharged sheet stacking portion (not illustrated) provided in a discharge portion of the image forming apparatus 1.

On the other hand, the toner (transfer residual toner) attached to the surface of the photoconductor drum 12 after the transfer is performed is removed by the cleaner 16 from the surface of the photoconductor drum 12 after the transfer is completed.

In this way, the image forming processing is repeatedly performed only for cycles for the number of printed sheets.

Figure 3:
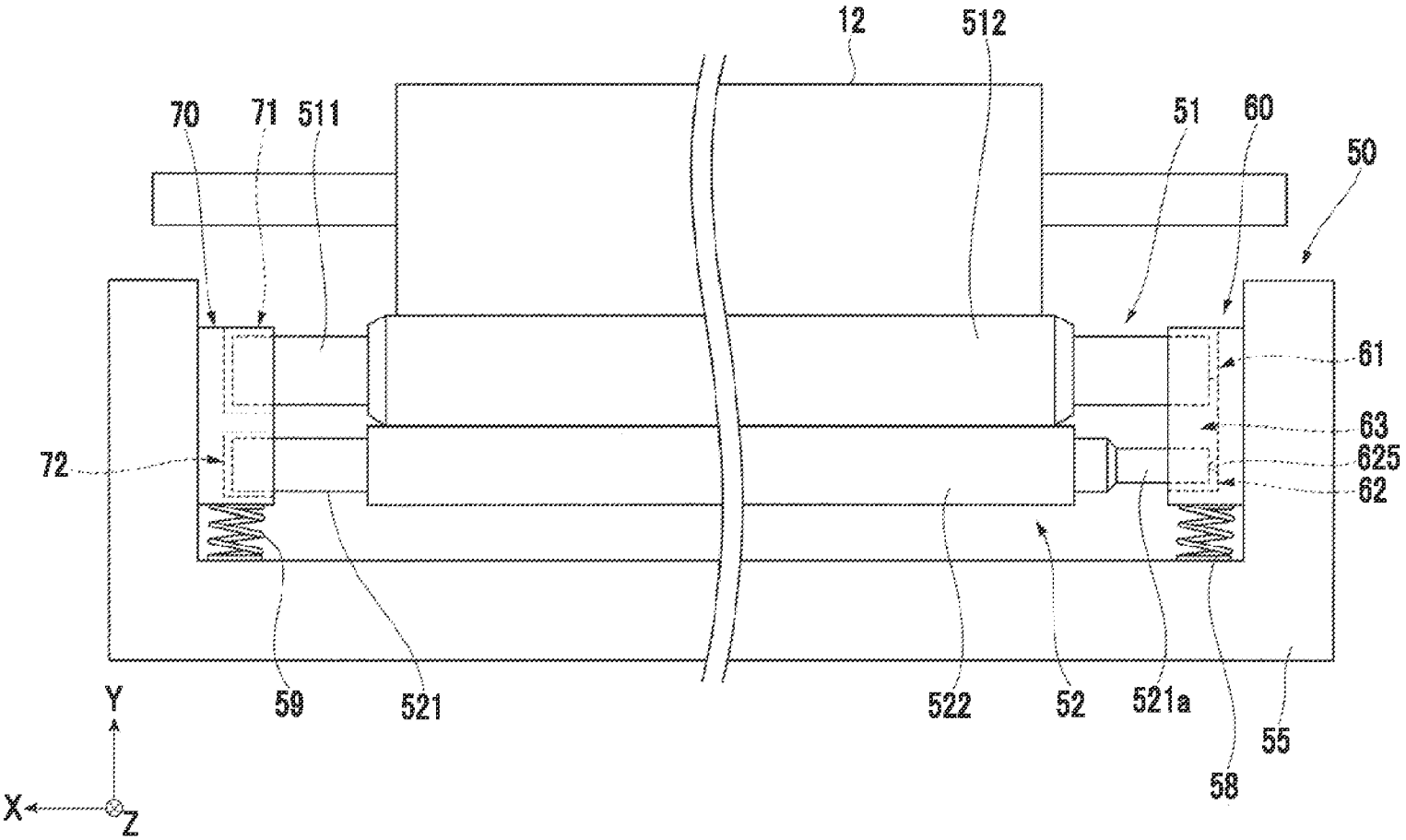
FIG. 3 is a view illustrating a photoconductor drum and a charging unit to which an exemplary embodiment is applied.

Subsequently, configurations of the photoconductor drum 12 and the charging unit 50 according to the exemplary embodiment are described. FIG. 3 is a view illustrating the photoconductor drum 12 and the charging unit 50 to which the exemplary embodiment is applied.

For example, the photoconductor drum 12 according to the exemplary embodiment is configured of a cylindrical body in which a photoconductor layer formed of an organic photoconductor, an inorganic photoconductor and the like is laminated on a drum-shaped conductive base and is rotatably driven in a predetermined direction (arrow direction A in FIG. 2) by a motor (not illustrated). Further, the conductive base of the photoconductor drum 12 is grounded in a state where the image forming module 100 (see FIG. 2) is installed on the image forming apparatus 1 (see FIG. 1).

As illustrated in FIGS. 2 and 3, the charging unit 50 according to the exemplary embodiment includes a charging roller 51 as an example of a charging member, which is rotatably supported and charges the photoconductor drum 12, and a cleaning roller 52 as an example of a cleaning member, which is rotatably supported and cleans the surface of the charging roller 51. Further, the charging unit 50 includes a front side bearing 60 as an example of a support member, which supports end portions of the front side of the charging roller 51 and the cleaning roller 52, and a rear side bearing 70 as an example of another support member, which supports end portions of the rear side of the charging roller 51 and the cleaning roller 52. Moreover, the charging unit 50 includes a housing 55 that accommodates the charging roller 51, the cleaning roller 52, the front side bearing 60 and the rear side bearing 70. Furthermore, the charging unit 50 includes elastic members 58 and 59 as an example of a pressing member, which press the charging roller 51 and the cleaning roller 52 to the side of the photoconductor drum 12 through the front side bearing 60 or the rear side bearing 70.

Moreover, the charging unit 50 according to the exemplary embodiment is configured so that shapes of the front side bearing 60 and the rear side bearing 70 are different from each other and additionally support methods of the charging roller 51 and the cleaning roller 52 are different from each other on the front side and the rear side, and the description thereof is given below in detail.

Here, as described above, the photoconductor drum 12 is disposed so that the axial direction of the rotating shaft is directed from the front side to the rear side of the image forming apparatus 1. Further, the charging roller 51 and the cleaning roller 52 are provided along the axial direction of the photoconductor drum 12, and the axial directions of the rotating shafts of the charging roller 51 and the cleaning roller 52 are also disposed so as to be directed from the front side toward the rear side of the image forming apparatus 1.

In the exemplary embodiment, as illustrated in FIG. 2, the charging roller 51 is rotatably driven in arrow direction B (see FIG. 2) by rotation of the photoconductor drum 12 that is driven by rotation of a motor (not illustrated). Further, the cleaning roller 52 is rotatably driven in arrow direction C (see FIG. 2) by the rotation of the charging roller 51.

Moreover, in the following description, as illustrated in FIG. 3, a direction (a direction from the front side to the rear side of the image forming apparatus 1 (see FIG. 1)) along the direction of the rotating shafts of the photoconductor drum 12, the charging roller 51 and the cleaning roller 52 is referred to as an X direction. Further, a pressing direction (a direction directing from the charging roller 51 to the photoconductor drum 12) of the charging roller 51 and the cleaning roller 52 with respect to the elastic members 58 and 59 is referred to as a Y direction. Furthermore, a moving direction (a direction directing from the front side to the depth side of the paper surface) of the photoconductor drum 12 in a portion where the photoconductor drum 12 is in contact with the charging roller 51 is referred to as a Z direction. Further, the Z direction is a direction orthogonal to the X direction and the Y direction.

The charging roller 51 according to the exemplary embodiment includes a charging shaft 511 as an example of a first shaft, which is provided along the X direction and is rotatably supported by the front side bearing 60 and the rear side bearing 70, and a charging layer 512 which is provided on an outer circumference of the charging shaft 511 and charges the photoconductor drum 12 by being in contact with the surface of the photoconductor drum 12.

The charging shaft 511 is configured of a material having conductivity such as metal. As illustrated in FIG. 3, the charging shaft 511 is configured so that a length thereof in the X direction is longer than that of the charging layer 512 and both end portions thereof protrude from both end portions of the charging layer 512. Then, the charging shaft 511 is configured so that an end portion of both end portions protruding from the charging layer 512 is supported by the front side bearing 60 and the other end portion is supported by the rear side bearing 70.

Moreover, a voltage is applied to the end portion of the rear side of the charging shaft 511 protruding from the charging layer 512 through the rear side bearing 70 by a high voltage source (power supply means) (not illustrated) and the description thereof is given below in detail.

The charging layer 512 has a cylindrical shape and is provided on an outer circumference of the charging shaft 511 so that the charging shaft 511 passes through a center portion thereof. In the exemplary embodiment, the charging layer 512 is in a state of being in contact with an outer circumferential surface of the photoconductor drum 12 and a cleaning layer 522 (described below) of the cleaning roller 52 when the charging unit 50 is installed in the image forming module 100 (see FIG. 2), and then the voltage is applied to the charging layer 512 through the charging shaft 511 and an electric field is applied to the photoconductor drum 12, the surface of the photoconductor drum 12 is thereby charged.

For example, the charging layer 512 may have a configuration in which a conductive elastic layer and a surface layer are sequentially laminated on the charging shaft 511.

As the conductive elastic layer, for example, a material may be used in which a conductive material such as carbon black or an ion-conductive material is added to an elastic material such as rubber having elasticity. Further, if necessary, a material such as a softener, plasticizer, curing agent, vulcanizing agent, vulcanization accelerator, antioxidant, and a filler such as silica and calcium carbonate which are capable of adding to a usual rubber may be added.

The surface layer is provided to suppress contamination of the charging layer 512 by foreign matter such as remaining toner. As the surface layer, for example, it is possible to use a material such as resin or rubber. Particularly, polyester, polyimide, copolymer nylon, silicone resin, acrylic polymer, polyvinyl butyral, ethylene-tetrafluoroethylene copolymer, melamine polymer, fluorine rubber, epoxy polymer, polycarbonate, polyvinyl alcohol, cellulose, polyvinylidene chloride, polyvinyl chloride, polyethylene, ethylene-vinyl acetate copolymer, and the like may be used.

Further, the surface layer may contain a conductive material to adjust a resistance value.

The cleaning roller 52 according to the exemplary embodiment includes a cleaning shaft 521 as an example of a second shaft, which is provided along the X direction and is rotatably supported by the front side bearing 60 and the rear side bearing 70, and the cleaning layer 522 which is provided on the outer circumference of the cleaning shaft 521 and cleans the surface of the charging layer 512 by contacting the charging layer 512 of the charging roller 51.

For example, the cleaning shaft 521 is configured of a polymer material, a metal material or the like. As illustrated in FIG. 3, the cleaning shaft 521 is provided so that a length thereof in the X direction is longer than that of the cleaning layer 522 and both end portions thereof protrude from the cleaning layer 522. Then, the cleaning shaft 521 is configured so that one end portion of both end portions protruding from the cleaning layer 522 is supported by the front side bearing 60 and the other end portion is supported by the rear side bearing 70.

Further, in the exemplary embodiment, a small diameter portion 521*a* that is formed having a diameter smaller than that of the other portions is provided in one end portion (the end portion on the front side) protruding from the cleaning layer 522 of the cleaning shaft 521.

In the exemplary embodiment, a diameter (a diameter of the second shaft; the diameter of the small diameter portion 521*a* and the diameter of portions other than the small diameter portion 521*a*) of the cleaning shaft 521 is formed so as to be smaller than a diameter (a diameter of the first shaft) of the charging shaft 511.

The cleaning layer 522 has a cylindrical shape and is provided on the outer circumference of the cleaning shaft 521 so that the cleaning shaft 521 passes through the center portion thereof. Then, in a state where the cleaning layer 522 is pressed relative to and is in contact with the charging layer 512 of the charging roller 51, the charging roller 51 and the cleaning roller 52 rotate in opposite directions, thereby cleaning off foreign matter such as dust or remaining toner attached to the charging layer 512 of the charging roller 51.

For example, the cleaning layer 522 is configured of a porous foam body. As such a porous material, for example, foamable rubber or polymer such as polyurethane, polyethylene, polyamide or polypropylene may be selected.

As the cleaning layer 522, in order to effectively clean off foreign matter by driven friction with the charging layer 512 of the charging roller 51 and to suppress scratching on the surface of the charging layer 512, and to cause breakage or damage to be unlikely to occur for long periods, it is particularly preferable that polyurethane that is strong in tear, tension or the like be used.

The housing 55 is provided along the X direction and accommodates the charging roller 51, the cleaning roller 52, the front side bearing 60, the rear side bearing 70 and the elastic members 58 and 59 inside thereof. Then, in the housing 55, the elastic members 58 and 59 are mounted on the end portion of the front side and the end portion of the rear side, respectively, and the front side bearing 60 and the rear side bearing 70 are mounted through the elastic members 58 and 59.

For example, the elastic members 58 and 59 are members having elasticity such as coil springs, and are provided between the housing 55 and the front side bearing 60 or the rear side bearing 70.

Particularly, the elastic member 58 is provided in such a manner that one end thereof is provided by being in contact with the housing 55 and the other end thereof is in contact with a front side contact portion 64 (described below) of the front side bearing 60. Similarly, the elastic member 59 is provided in such a manner that one end thereof is provided by being in contact with the housing 55 and the other end thereof is in contact with a rear side contact portion 74 (described below) of the rear side bearing 70.

Then, in a state where the charging unit 50 is mounted on the image forming module 100 (see FIG. 2), the elastic members 58 and 59 press the charging roller 51 to the side of the photoconductor drum 12 through the front side bearing 60 and the rear side bearing 70.

Figure 4:
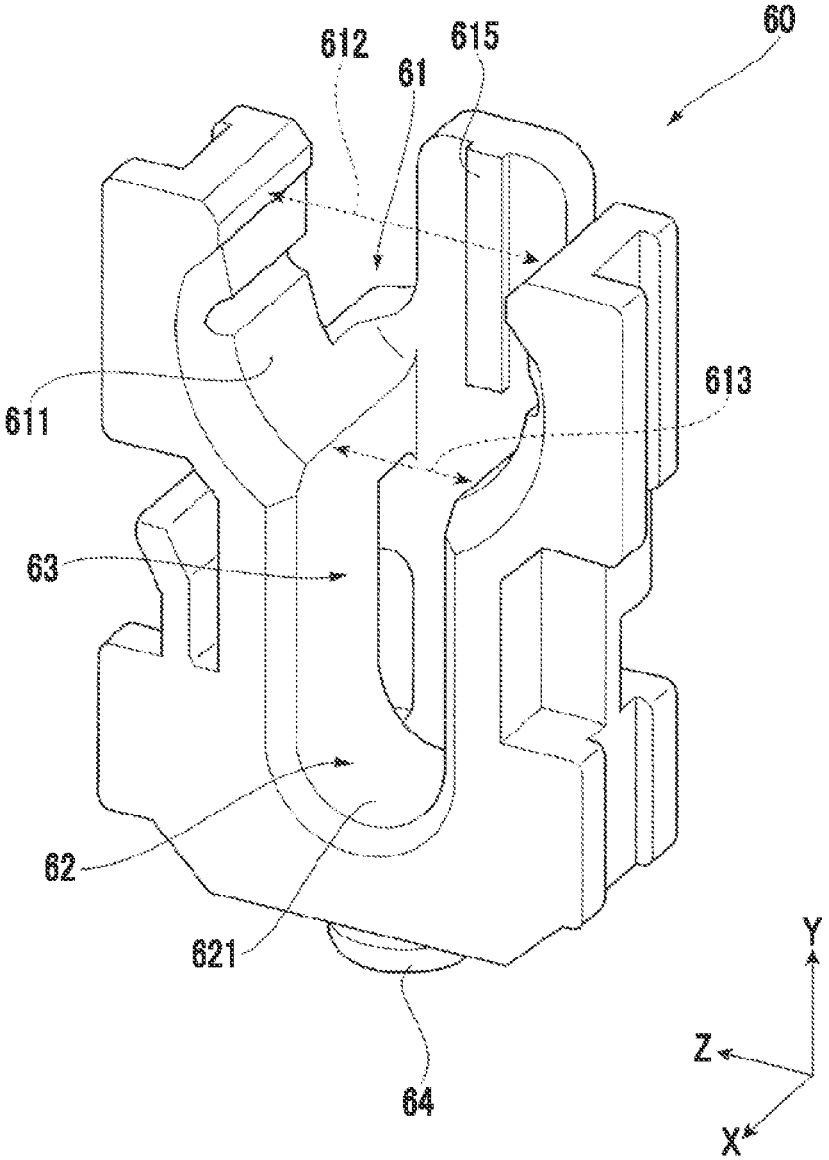
FIG. 4 is a perspective view illustrating a front side bearing to which an exemplary embodiment is applied.

Subsequently, a configuration of the front side bearing 60 is described. FIG. 4 is a perspective view illustrating the front side bearing 60 to which the exemplary embodiment is applied.

As illustrated in FIG. 4, the front side bearing 60 includes a charging bearing portion 61 that supports one end portion (the end portion on the front side) in the charging shaft 511 (see FIG. 3) of the charging roller 51 (see FIG. 3), a cleaning bearing portion 62 that supports the small diameter portion 521*a* (see FIG. 3) formed on the cleaning shaft 521 (see FIG. 3) of the cleaning roller 52 (see FIG. 3), and a connection portion 63 for connecting the charging bearing portion 61 to the cleaning bearing portion 62.

Further, the front side bearing portion includes the front side contact portion 64, which one end of the elastic member 58 (see FIG. 3) is in contact on an outer surface (lower side in FIG. 4) thereof.

The charging bearing portion 61 is an example of a first support portion and, as illustrated in FIG. 4, has a concave shape that is open toward a downstream side (rear side) in the X direction.

Further, a shape of the charging bearing portion 61 viewed from the X direction is an arc shape and the charging bearing portion 61 has a cylindrical wall surface (charging bearing surface 611).

In the charging bearing surface 611, as illustrated in FIG. 4, a first notch 612 as an example of an opening or a first opening portion is formed on the downstream side (upward in the view, the side on which the photoconductor drum 12 is provided) in the Y direction. Therefore, the charging bearing portion 61 has a state of being opened toward the downstream side in the Y direction through the first notch 612.

Further, in the charging bearing surface 611, a second notch 613 as an example of a second opening portion is formed on the upstream side (the side of the cleaning bearing portion 62) in the Y direction. Therefore, the charging bearing portion 61 has a state of communicating with the connection portion 63 through the second notch 613.

The charging bearing surface 611 is a support surface for supporting an end portion of the charging shaft 511 of the charging roller 51 on the front side, and a diameter (a maximum distance between opposite surfaces of the charging bearing surface 611) of the charging bearing surface 611 is formed to be slightly greater than that of the charging shaft 511.

Therefore, the charging bearing portion 61 may rotatably support the charging shaft 511 while allowing an outer circumferential surface of the charging shaft 511 to be in contact with the charging bearing surface 611.

Further, a width of the first notch 612 in the Z direction is set to be greater than the diameter of the charging shaft 511. Therefore, it is possible to insert the charging shaft 511 into the charging bearing portion 61 from the downstream side in the Y direction toward the upstream side in the Y direction (toward the lower side in the view) through the first notch 612.

Further, a width of the second notch 613 in the Z direction is set to be smaller than the diameter of the charging shaft 511. Therefore, when the charging shaft 511 is inserted into the charging bearing portion 61 through the first notch 612, it is possible for the charging shaft 511 to suppress to be inserted into the connection portion 63 or the cleaning bearing portion 62 through the second notch 613. Then, when the charging shaft is inserted into the charging bearing portion 61, a region of a part of the outer circumferential surface of the charging shaft 511 contacts the charging bearing surface 611.

Furthermore, a width of the second notch 613 in the Z direction is set to be greater than the diameter of the small diameter portion 521*a* of the cleaning shaft 521.

Moreover, in the exemplary embodiment, the charging bearing portion 61 has a charging contact portion 615 that regulates movement of the charging shaft 511 in the X direction by contacting from the upstream side in the X direction an end portion of the charging shaft 511 inserted into the charging bearing portion 61 on the upstream side in the X direction.

Subsequently, the cleaning bearing portion 62 is an example of a second support portion and, as illustrated in FIG. 4, has a concave shape that is open toward the downstream side (rear side) in the X direction.

Further, a shape of the cleaning bearing portion 62 viewed from the X direction is a U shape and the cleaning bearing portion 62 has a wall surface (a cleaning bearing surface 621) having a U-shaped cross section.

The cleaning bearing surface 621 is a support surface for supporting the small diameter portion 521*a* of the cleaning shaft 521 of the cleaning roller 52 and a distance between opposite surfaces of the cleaning bearing surface 621 in the Z direction is formed to be slightly greater than the diameter of the small diameter portion 521*a* of the cleaning shaft 521. Further, a portion of the cleaning bearing surface 621 on the upstream side (lower side in the view) in the Y direction has a bent shape so as to follow an outer circumferential shape of the cleaning shaft 521.

Therefore, the cleaning bearing portion 62 may rotatably support the cleaning shaft 521 on the cleaning bearing surface 621 while being in contact with the outer circumferential surface of the small diameter portion 521*a* of the cleaning shaft 521.

Furthermore, in the exemplary embodiment, the cleaning bearing portion 62 has a cleaning contact portion 625 that regulates movement of the cleaning shaft 521 in the X direction by contacting from the upstream side in the X direction an end portion of the small diameter portion 521*a* of the cleaning shaft 521 inserted into the cleaning bearing portion 62 on the upstream side in the X direction (see FIG. 3 and FIG. 7 described below).

Subsequently, the connection portion 63 connects the charging bearing portion 61 described above to the cleaning bearing portion 62. Particularly, as illustrated in FIG. 4, the connection portion 63 is configured of two surfaces that connect the second notch 613 formed on the charging bearing surface 611 of the charging bearing portion 61 to the end portion of the cleaning bearing surface 621 of the cleaning bearing portion 62 on the downstream side in the Y direction, and face each other in the Z direction.

In the exemplary embodiment, a distance between two surfaces configuring the connection portion 63 is formed to be greater than the diameter of the small diameter portion 521*a* of the cleaning shaft 521. Therefore, when the small diameter portion 521*a* of the cleaning shaft 521 is inserted into the front side bearing 60 from the first notch 612 formed in the charging bearing portion 61, it is possible to insert the small diameter portion 521*a* to the cleaning bearing portion 62 through the charging bearing portion 61 and the connection portion 63.

Figure 5:
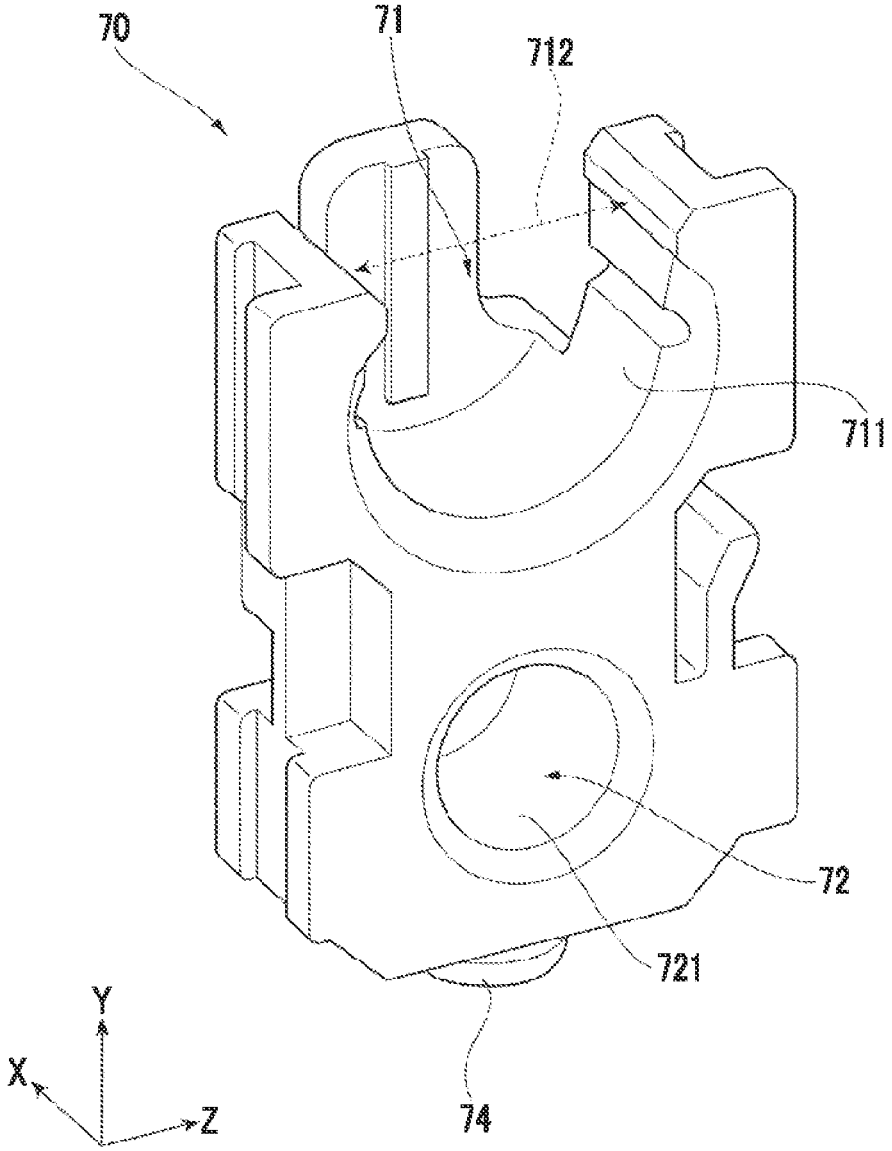
FIG. 5 is a perspective view illustrating a rear side bearing to which an exemplary embodiment is applied.

Subsequently, a configuration of the rear side bearing 70 is described. FIG. 5 is a perspective view illustrating the rear side bearing 70 to which the exemplary embodiment is applied.

As illustrated in FIG. 5, the rear side bearing 70 is provided with a charging bearing hole 71 that supports one end portion (the end portion on the rear side) of the charging shaft 511 (see FIG. 3) of the charging roller 51 (see FIG. 3) and a cleaning bearing hole 72 that supports one end portion (the end portion on the rear side) of the cleaning shaft 521 (see FIG. 3) of the cleaning roller 52 (see FIG. 3).

Further, the rear side bearing 70 includes the rear side contact portion 74 which one end of the elastic member 59 (see FIG. 3) is in contact on an outer circumferential surface (lower side in the view) thereof.

Moreover, the rear side bearing 70 does not have a configuration that connects the charging bearing hole 71 to the cleaning bearing hole 72 as the connection portion 63 (see FIG. 4) described above.

Further, the charging bearing hole 71 is an example of a third support portion and, as illustrated in FIG. 5, has a concave shape that is open on the upstream side (front side) in the X direction.

Further, a shape of the charging bearing hole 71 viewed from the X direction is an arc shape and the charging bearing hole 71 has a cylindrical wall surface (a charging bearing surface 711).

As illustrated in FIG. 5, in the charging bearing surface 711, a notch 712 is formed on the downstream side (the side on which the photoconductor drum 12 is provided) in the Y direction. Therefore, the charging bearing hole 71 is in a state of being open to the downstream side in the Y direction through the notch 712.

Moreover, it is not necessary to provide the notch 712 and, for example, the charging bearing surface 711 may have a cylindrical shape that is connected in the circumferential direction without having the notch 712.

The charging bearing surface 711 is a support surface for supporting the end portion of the charging shaft 511 of the charging roller 51 on the rear side, and a diameter (the maximum distance between opposite surfaces of the charging bearing surface 711) of the charging bearing surface 711 is formed to be slightly greater than that of the charging shaft 511.

Therefore, the charging bearing hole 71 may rotatably support the charging shaft 511 while allowing the outer circumferential surface of the charging shaft 511 to contact the charging bearing surface 711.

Further, a width of the notch 712 in the Z direction is set to be greater than the diameter of the charging shaft 511. Therefore, it is possible to insert the charging shaft 511 into the charging bearing hole 71 through the notch 712.

The cleaning bearing hole 72 is an example of a fourth support portion and, as illustrated in FIG. 5, has a concave shape that is open toward the upstream side (front side) in the X direction. Particularly, the cleaning bearing hole 72 has a columnar space on the inside thereof and has a cylindrical wall surface (a cleaning bearing surface 721) on the circumference thereof.

The cleaning bearing surface 721 is a support surface for supporting the end portion of the cleaning shaft 521 of the cleaning roller 52 on the rear side and a diameter of the cylindrical cleaning bearing surface 721 is formed to be slightly greater than that of the cleaning shaft 521 (the portion other than the small diameter portion 521*a*). Therefore, the cleaning bearing hole 72 may rotatably support the cleaning shaft 521 while allowing the outer circumferential surface of the end portion of the cleaning shaft 521 on the rear side to contact the cleaning bearing surface 721.

Figure 6A:
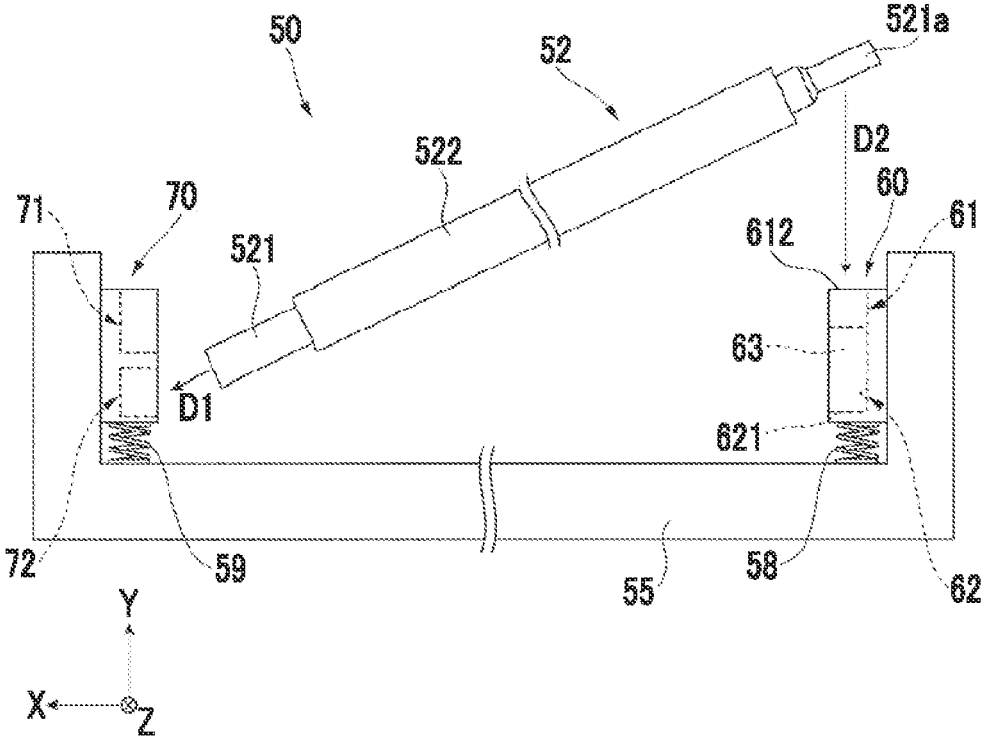
FIGS. 6A and 6B are views illustrating an example of assembly procedure of a charging unit to which an exemplary embodiment is applied.
Figure 6B:
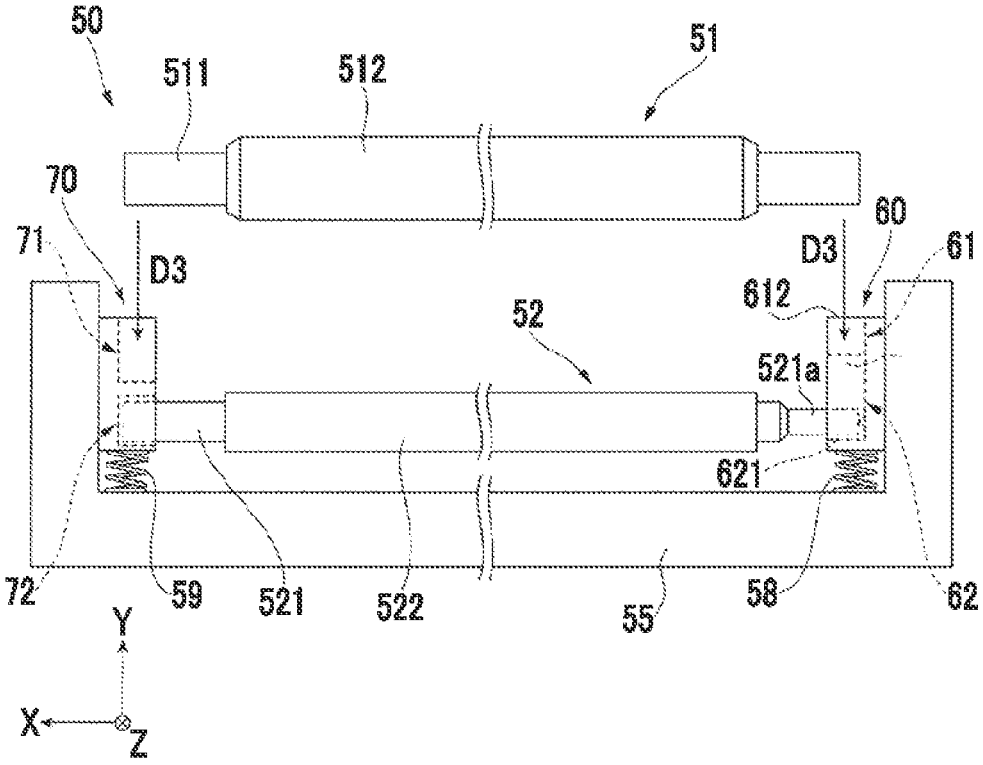

Subsequently, an example of assembly procedure of the charging unit 50 illustrated in FIG. 3 is described. FIGS. 6A and 6B are views illustrating an example of assembly procedure of the charging unit 50 to which the exemplary embodiment is applied.

For assembling the charging unit 50, first, the elastic members 58 and 59, the front side bearing 60 and the rear side bearing 70 are mounted on the housing 55. Particularly, one end portions of the elastic members 58 and 59 are mounted on the housing 55 in the Y direction, the front side bearing 60 is mounted on the other end portion of the elastic member 58 through the front side contact portion 64 (see FIG. 4), and the rear side bearing 70 is mounted on the other end portion of the elastic member 59 through the rear side contact portion 74 (see FIG. 5).

Subsequently, the cleaning roller 52 is mounted on the front side bearing 60 and the rear side bearing 70 which are mounted on the housing 55 through the elastic members 58 and 59.

For mounting the cleaning roller 52, first, as illustrated by arrow D1 in FIG. 6A, one end portion (the end portion in which the small diameter portion 521*a* is not provided) of the cleaning shaft 521 of the cleaning roller 52 is inserted from the upstream side in the X direction into the cleaning bearing hole 72 of the rear side bearing 70.

Next, in a state where the end portion of the cleaning shaft 521 on the rear side is inserted into the cleaning bearing hole 72 of the rear side bearing 70, as illustrated by arrow D2 in FIG. 6A, the small diameter portion 521*a* of the cleaning shaft 521 formed on the front side is inserted into the front side bearing 60.

Particularly, first, the small diameter portion 521*a* of the cleaning shaft 521 is inserted into the charging bearing portion 61 of the front side bearing 60 through the first notch 612. Then, the small diameter portion 521*a* inserted into the charging bearing portion 61 is further moved along a direction indicated by arrow D2 and is inserted into the cleaning bearing portion 62 through the connection portion 63. Therefore, the small diameter portion 521*a* of the cleaning shaft 521 comes in contact with the cleaning bearing surface 621 of the cleaning bearing portion 62.

As described above, one end portion of the cleaning shaft 521 is supported on the rear side bearing 70 and the other end portion (the small diameter portion 521*a*) is in a state of being supported on the front side bearing 60, and then mounting of the cleaning roller 52 is completed.

Subsequently, the charging roller 51 is mounted on the front side bearing 60 and the rear side bearing 70 on which the cleaning roller 52 is mounted.

For mounting the charging roller 51, one end portion of the charging shaft 511 is inserted into the charging bearing hole 71 through the notch 712 (see FIG. 5) of the rear side bearing 70 along arrow direction D3 in FIG. 6B and the other end portion of the charging shaft 511 is inserted into the charging bearing portion 61 through the first notch 612 of the front side bearing 60.

Therefore, one end portion of the charging shaft 511 becomes in a state of being in contact with the charging bearing surface 711 (see FIG. 5) of the rear side bearing 70 and the other end portion becomes in a state of being in contact with the charging bearing surface 611 (see FIG. 4) of the front side bearing 60.

As a result, one end portion of the charging shaft 511 becomes in a state of being supported on the rear side bearing 70 and the other end portion becomes in a state of being supported on the front side bearing 60, and then the mounting of the charging roller 51 is completed. Further in this state, the surface of the charging layer 512 of the charging roller 51 is in contact with the surface of the cleaning layer 522 of the cleaning roller 52.

As described above, the charging unit 50 including the charging roller 51 and the cleaning roller 52 is obtained.

Thereafter, the charging unit 50 on which the charging roller 51 and the cleaning roller 52 are mounted is mounted on the image forming apparatus 1 (the image forming module 100) on which the photoconductor drum 12 is mounted. Therefore, the charging unit 50 is fixed to the image forming module 100 and becomes in a state of that illustrated in FIG. 3.

That is, the front side bearing 60 and the rear side bearing 70 are pressed toward the downstream side in the Y direction by a pressing force of the elastic members 58 and 59. As a result, the charging layer 512 of the charging roller 51 becomes in a state of being pressed and being in contact with the surface of the photoconductor drum 12.

Further, in the state illustrated in FIG. 3, the cleaning layer 522 of the cleaning roller 52 is pressed to the surface of the charging layer 512 of the charging roller 51 by the pressing force of the elastic members 58 and 59. Moreover, in this case, the charging layer 512 of the charging roller 51 and the cleaning layer 522 of the cleaning roller 52 are mounted on the housing 55 (the front side bearing 60 and the rear side bearing 70) in a state where a pressure that presses relative to each other operates. Thus, the charging layer 512 is in a state of biting into the cleaning layer 522 that is configured of a porous polymer or the like.

As described above, in the charging unit 50 according to the exemplary embodiment, it is possible to perform the mounting of the cleaning roller 52 and charging roller 51 on the front side bearing 60 and the rear side bearing 70 mounted on the housing 55 with a simple operation. Therefore, in the charging unit 50 according to the exemplary embodiment, it is possible to improve work efficiency in assembling work of the charging unit compared to a charging unit in which respective both end portions of the cleaning roller 52 and the charging roller 51 are supported, for example, on hole-shaped bearings without having notches.

Particularly, if the bearings for supporting the charging roller 51 and the cleaning roller 52 are, for example, hole shapes on both sides of the front side and the rear side, when the charging roller 51 or the like is mounted on the charging unit, it is necessary to remove the bearing from the housing or to widen a gap between the bearings and then the work efficiency of the assembling work of the charging unit may be lowered.

On the other hand, in the exemplary embodiment, as described above, it is possible to perform the mounting of the cleaning roller 52 and the charging roller 51 on the charging unit 50 only by inserting the cleaning roller 52 and the charging roller 51 in a state where the front side bearing 60 and the rear side bearing 70 are mounted on the housing 55. Therefore, in the exemplary embodiment, it is possible to suppress lowering of the work efficiency in the assembling work of the charging unit 50, compared to a case where the configuration is not employed.

Further, in the charging unit 50 according to the exemplary embodiment, as illustrated in FIG. 3, it is possible to support both end portions of the charging roller 51 (the charging shaft 511) and both end portions of the cleaning roller 52 (the cleaning shaft 521) by the front side bearing 60 and the rear side bearing 70 in a state where the positions thereof are equal in the X direction and overlap each other in the Y direction.

Therefore, for example, it is possible to shorten the length of the charging unit 50 in the X direction by lengthening the charging shaft 511 further than the cleaning shaft 521, and the like, compared to a case where the position supporting the charging roller 51 and the position supporting the cleaning roller 52 are supported by being displaced in the X direction (that is, in the position that does not overlap in the Y direction). Therefore, according to the exemplary embodiment, it is possible to miniaturize the charging unit 50 compared to a case where the configuration is not employed.

Further, in the charging unit 50 according to the exemplary embodiment, both end portions of the charging roller 51 and both end portions of the cleaning roller 52 are supported in a state of overlapping each other in the Y direction, whereby it is possible to suppress the front side bearing 60 and the rear side bearing 70 from falling in the X direction compared to a case where the configuration is not employed. Therefore, in the exemplary embodiment, it is possible to stably press the charging roller 51 and the cleaning roller 52 in the Y direction by the elastic members 58 and 59 through the front side bearing 60 and the rear side bearing 70.

As a result, it is possible to maintain good adhesion between the photoconductor drum 12 and the charging roller 51 and to effectively perform the charging of the photoconductor drum 12 compared to a case where the configuration is not employed. Furthermore, it is possible to maintain good adhesion between the charging roller 51 and the cleaning roller 52 and to perform good cleaning of the charging roller 51.

Further, as described above, in the exemplary embodiment, the small diameter portion 521*a* is provided in one end portion of the cleaning shaft 521 and the small diameter portion 521*a* is inserted into the front side bearing 60, whereby the mounting of the cleaning roller 52 is performed.

In the exemplary embodiment, the small diameter portion 521*a* is provided, whereby it is possible to reduce the width of the second notch 613 for inserting the cleaning shaft 521 into the front side bearing 60 compared to a case where, for example, the diameter of the cleaning shaft 521 is the same from one end to the other end. Therefore, in the front side bearing 60, it is possible to increase a contact area between the outer circumferential surface of the charging shaft 511 and the charging bearing surface 611 of the charging bearing portion 61 compared to a case where the configuration is not employed. As a result, it is possible to perform good support of the charging roller 51 by the front side bearing 60 and to perform good contact between the charging roller 51 and the photoconductor drum 12 compared to a case where the configuration is not employed.

Further, in the cleaning roller 52 according to the exemplary embodiment, the small diameter portion 521*a* is provided only in one end portion of the cleaning shaft 521, which is supported on the front side bearing 60, and the diameter of the portion that supports the cleaning layer 522 and the portion that is supported on the rear side bearing 70 are greater than that of the small diameter portion 521*a*.

Therefore, even if the cleaning roller 52 is pressed to the charging roller 51, the cleaning roller 52 is unlikely to deflect compared to a case where an entirety of the cleaning shaft 521 has a small diameter. As a result, it is possible to perform good contact between the cleaning roller 52 (the cleaning layer 522) and the charging roller 51 (the charging layer 512) and to effectively perform the cleaning of the surface of the charging roller 51 by the cleaning roller 52 compared to a case where the configuration is not employed.

Here, in the exemplary embodiment, as described above, the voltage is applied from the rear side to the charging roller 51 through the rear side bearing 70. This is due to the following reasons.

That is, in the charging bearing portion 61 of the front side bearing 60, the second notch 613 being in contact with the connection portion 63 is formed on the upstream side of the charging bearing surface 611 in the Y direction. On the other hand, since the connection portion is not formed in the rear side bearing 70, in the charging bearing hole 71, a notch is not formed on the upstream side of the charging bearing surface 711 in the Y direction.

Therefore, in the charging unit 50 according to the exemplary embodiment, the contact area between the charging shaft 511 and the charging bearing surface 711 of the rear side bearing 70 becomes large compared to the contact area between the charging shaft 511 and the charging bearing surface 611 of the front side bearing 60.

Therefore, in the exemplary embodiment, the voltage is applied from the rear side to the charging roller 51 through the rear side bearing 70, whereby it is possible to efficiently perform the application of the voltage to the charging roller 51 compared to a case where the voltage is applied from the front side to the charging roller 51 through the front side bearing 60.

Moreover, in the charging unit 50 according to the exemplary embodiment, the shape of the rear side bearing 70 is different from that of the front side bearing 60, but the bearing having the same shape as the front side bearing 60 illustrated in FIG. 4 may be used in both the front side and the rear side of the charging unit 50.

Further, the bearing having the same shape as the front side bearing 60 illustrated in FIG. 4 may be used on the rear side of the charging unit 50 and the bearing having the same shape as the rear side bearing 70 illustrated in FIG. 5 may be used on the front side of the charging unit 50.

Second Exemplary Embodiment

Subsequently, a second exemplary embodiment of the invention is described. The second exemplary embodiment has the same configuration as the first exemplary embodiment except that the shape of the front side bearing 60 is different from the first exemplary embodiment described above. Therefore, hereinafter, the front side bearing 60 according to the second exemplary embodiment is described. Moreover, in the following description, the same reference numerals are given to the same configurations as the first exemplary embodiment and detailed description thereof is omitted.

Figure 7:
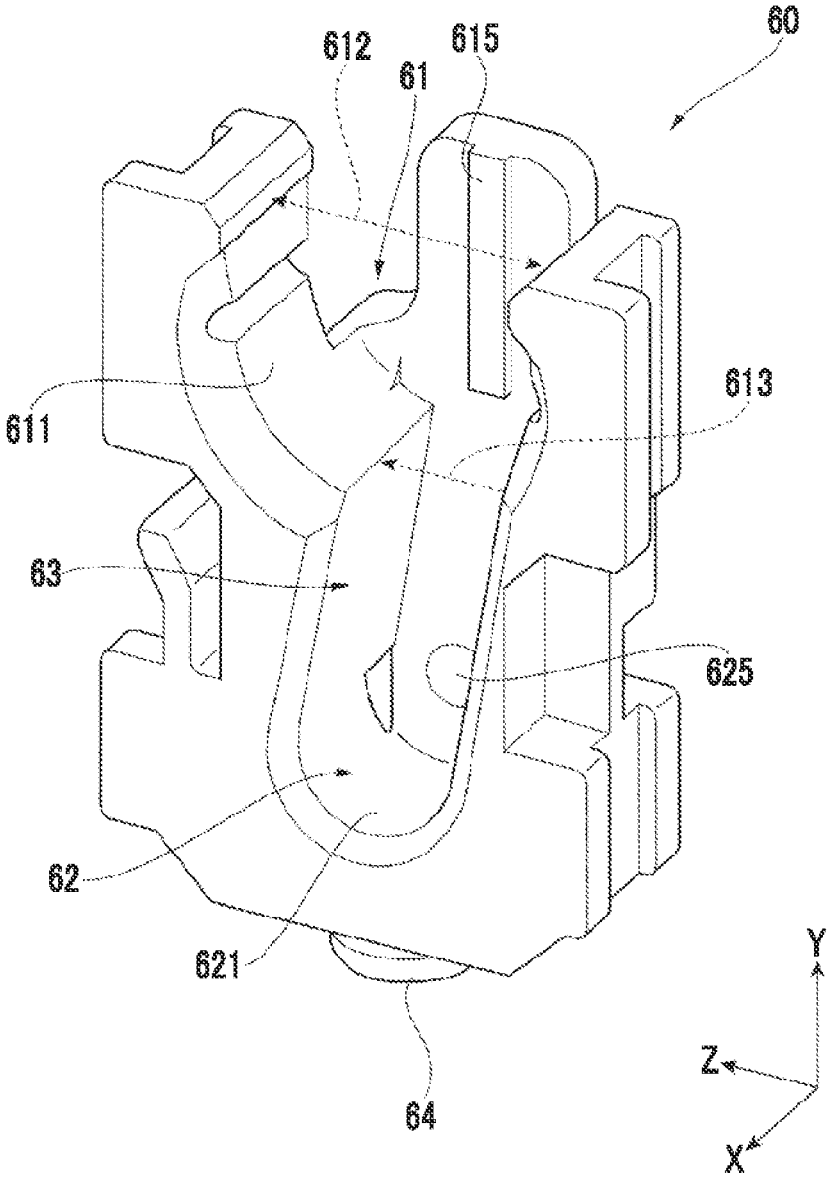
FIG. 7 is a perspective view illustrating a front side bearing to which a second exemplary embodiment of the invention is applied.

FIG. 7 is a perspective view illustrating the front side bearing 60 to which the second exemplary embodiment of the invention is applied.

Similar to the first exemplary embodiment, the front side bearing 60 according to the second exemplary embodiment includes the charging bearing portion 61 that supports an end portion of the charging shaft 511 of the charging roller 51 on the front side, the cleaning bearing portion 62 that supports the small diameter portion 521*a* formed on the cleaning shaft 521 of the cleaning roller 52, and the connection portion 63 that connects the charging bearing portion 61 and the cleaning bearing portion 62.

Here, in the front side bearing 60 according to the exemplary embodiment, the position of the second notch 613 formed in the charging bearing portion 61 is different from the front side bearing 60 according to the first exemplary embodiment.

That is, in the first exemplary embodiment, as illustrated in FIG. 4, the second notch 613 of the charging bearing portion 61 is provided on the upstream side of the charging bearing surface 611 in the Y direction so as to face the first notch 612.

On the other hand, in the embodiment, as illustrated in FIG. 7, the first notch 612 of the charging bearing portion 61 is provided in a position moved on the upstream side in the Z direction compared to the first notch 612 illustrated in FIG. 4.

In the exemplary embodiment, as illustrated in FIG. 7, the first notch 612 is provided by being displaced on the upper side in the Z direction, whereby the area of the charging bearing surface 611 that is positioned on the upstream side in the Y direction is large compared to the first exemplary embodiment illustrated in FIG. 4.

Then, when the charging roller 51 is mounted on the front side bearing 60, an outer circumferential surface of the charging shaft 511 of the charging roller 51 is in contact with the first bearing surface 61 in the region.

Here, as described in the first exemplary embodiment, when the charging unit 50 on which the charging roller 51 and the cleaning roller 52 are mounted is fixed to the image forming module 100 (the image forming apparatus 1; see FIGS. 1 and 2), the charging roller 51 and the cleaning roller 52 become in a state where the pressure that presses relative to each other operates.

As a result, also in the front side bearing 60, the end portion of the charging shaft 511 of the charging roller 51 on the front side is pressed to the charging bearing surface 611 of the front side bearing 60 toward the upstream side in the Y direction.

In the front side bearing 60 according to the exemplary embodiment, the second notch 613 is provided by being displaced on the upstream side in the Z direction, whereby it is possible to bring the outer circumferential surface of the charging shaft 511 and the charging bearing surface 611 into contact in a portion on the upstream side in the Y direction, in which a force from the charging roller 51 is likely to be applied in a case where the charging unit 50 is fixed to the image forming module 100.

As a result, it is possible to stably press the charging roller 51 to the photoconductor drum 12 and to maintain good adhesion between the photoconductor drum 12 and the charging roller 51 compared to a case where the configuration is not employed.

As described above, in the charging unit 50 according to the exemplary embodiment of the invention, the charging bearing portion 61 and the cleaning bearing portion 62 are connected through the connection portion 63 in the front side bearing 60, whereby it is possible to perform the mounting of the charging roller 51 and the cleaning roller 52 with a simple operation in the assembling of the charging unit 50.

Further, in the charging unit 50, it is possible to stably support the charging roller 51 and the cleaning roller 52, to perform good contact of the charging roller 51 (the charging layer 512) with the photoconductor drum 12, and to maintain good contact of the cleaning roller 52 (the cleaning layer 522) with the charging roller 51 (the charging layer 512) compared to a case where the configuration is not employed. As a result, it is possible to suppress the occurrence of charging failure of the photoconductor drum 12 and to satisfactorily perform removing of foreign matter from the surface of the charging roller 51.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging unit comprising:

a charging member that is rotatably provided and configured to come in contact with a surface of an image holding member holding an image to charge the image holding member;

a cleaning member that is rotatably provided and configured to come in contact with a surface of the charging member to clean the charging member;

a support member comprising:

a first support portion which is provided with an opening portion that opens in a direction intersecting rotating shafts of the charging member and the cleaning member, and which is configured to support a first end of the charging member; and a second support portion which is formed by being connected to the first support portion and which is configured to support a first end of the cleaning member which is inserted from the opening portion through the first support portion; and a pressing member configured to press the support member toward the image holding member, wherein the first support portion and the second support portion are connected in a direction displaced from a pressing direction by the pressing member.

2. The charging unit according to claim 1, wherein a small diameter portion having a diameter smaller than that of another portion is formed in the first end of the cleaning member, and the second support portion of the support member is configured to support the small diameter portion of the cleaning member.

3. The charging unit according to claim 1, further comprising:

a second support member comprising:

a third support portion supporting a second end opposite to the first end of the charging member; and a fourth support portion supporting a second end opposite to the first end of the cleaning member without being connected to the third support portion; and a feeding unit configured to supply power to the charging member through the other support member.

4. The charging unit according to claim 3, wherein the fourth support portion comprises a hole which is separated from the third support portion which is hollow.

5. A charging unit comprising:

a charging member configured to rotate about a first shaft having a first shaft diameter and to come in contact with a surface of an image holding member holding an image to charge the image holding member;

a cleaning member configured to rotate about a second shaft having a second shaft diameter smaller than that of the first shaft and comes in contact with a surface of the charging member to clean the charging member;

a support member configured to support the first shaft of the charging member and the second shaft of the cleaning member; and a pressing member configured to press the support member toward the image holding member wherein the support member comprises:

a first support portion that is provided with a first opening portion that opens in a direction intersecting the first shaft and has a width wider than the first shaft diameter, and a second opening portion that opens in a direction intersecting the first shaft and has a width narrower than the diameter of the first shaft and wider than the second shaft diameter, and supports one end of the first shaft between the first opening portion and the second opening portion; and a second support portion that is connected to the first support portion through the second opening portion and supports one end of the second shaft, and wherein the first support portion and the second support portion are connected in a direction displaced from a pressing direction by the pressing member.

6. An image forming apparatus comprising:

an image holding member that is rotatably provided and configured to hold an image;

a charging member that is rotatably provided and configured to come in contact with a surface of the image holding member to charge the image holding member;

a cleaning member that is rotatably provided and configured to come in contact with a surface of the charging member to clean the charging member;

a support member comprising:

a first support portion which is provided with an opening portion that opens in a direction intersecting rotating shafts of the charging member and the cleaning member, and which supports one end of the charging member is inserted through the opening portion; and a second support portion which is formed by being connected to the first support portion and which supports one end of the cleaning member which is inserted from the opening portion through the first support portion; and a pressing member configured to press the support member toward the image holding member, wherein the first support portion and the second support portion are connected in a direction displaced from a pressing direction by the pressing member.

7. The image forming apparatus according to claim 6, wherein the opening portion of the support member opens to a side of the image holding member, and the support member is pressed to a side of the image holding member, so that the charging member is positioned with respect to the image holding member by coming in contact with the image holding member.

8. A charging unit comprising:

a charging member that is rotatably provided and comes in contact with a surface of an image holding member holding an image to charge the image holding member;

a cleaning member that is rotatably provided and comes in contact with a surface of the charging member to clean the charging member;

a first support member comprising:

a first support portion which is provided with an opening portion that opens in a direction intersecting rotating shafts of the charging member and the cleaning member, and which supports a first end of the charging member; and a second support portion which is formed by being connected to the first support portion and which supports a first end of the cleaning member which is inserted from the opening portion through the first support portion; and a second support member comprising:

a third support portion configured to support a second end opposite to the first end of the charging member; and a fourth support portion configured to support a second end opposite to the first end of the cleaning member; and a pressing member configured to press the first and second support members toward the image holding member, wherein the first support portion and the second support portion are connected in a direction displaced from a pressing direction by the pressing member.

* * * * *